US005752876A

United States Patent [19]

Hettes

[11] Patent Number: 5,752,876

[45] Date of Patent: May 19, 1998

[54] FLAP DISC ABRASIVE TOOL

[75] Inventor: Frank J. Hettes, Greentown, Pa.

[73] Assignee: Weiler Brush Company, Inc., Cresco, Pa.

[21] Appl. No.: 546,970

[22] Filed: Oct. 23, 1995

[51] Int. Cl.[6] ..... B24D 13/04

[52] U.S. Cl. ..... 451/463; 451/533; 451/537

[58] Field of Search ..... 451/463, 466, 451/465, 533, 537, 544

[56] References Cited

U.S. PATENT DOCUMENTS

| | | | |
|---|---|---|---|
| 2,958,593 | 11/1960 | Hoover et al. . | |
| 4,437,271 | 3/1984 | McAvoy . | |
| 4,679,360 | 7/1987 | Eisenblatter | 451/466 |

FOREIGN PATENT DOCUMENTS

| | | | |
|---|---|---|---|
| 4208269 | 9/1993 | Germany | 451/466 |
| 0114470 | 6/1985 | Japan | 451/466 |

OTHER PUBLICATIONS

MAN Modern Application News, The Metalworking Idea Magazine, Fibre Discs vs. Flap Discs, Jun. 1994, vol. 28, No. 5.

*Primary Examiner*—Robert A. Rose

*Attorney, Agent, or Firm*—Seidel Gonda Lavorgna & Monaco, PC

[57] ABSTRACT

A flap disc for use with a rotary surface finishing tool, the flap disc includes a backing plate which attaches to and is rotated by the finishing tool. The backing plate has a mounting flange on which a plurality of abrasive flaps are radially disposed. The abrasive flaps are each adhesively attached to the mounting flange and positioned so as to overlap an adjacent flap. Each abrasive flap has a finishing layer which comprises abrasive particles intermixed in a resin binder. Attached to the finishing layer is a substrate which includes a resin binder. In one embodiment of the invention, the substrate is made from fiber material onto which the abrasive particle/resin mixture is adhesively attached. Alternately, the substrate may comprise a non-woven fibrous material onto which the abrasive particle/resin mixture is adhesively bonded. The mounting flange may comprise a plurality of fiberglass plies intermixed in a resin matrix. Abrasive particles are, preferably, incorporated into the resin matrix so that if the abrasive flaps are completely torn away, the abrasive particles in the mounting flange will continue to sand the surface of the work piece.

8 Claims, 4 Drawing Sheets

FLAP DISC ABRASIVE TOOL

FIELD OF THE INVENTION

The invention relates to surface finishing apparatus and, more particularly, to a rotatably driven surface finishing disc for use in sanding and polishing a work surface.

BACKGROUND OF THE INVENTION

A variety of surface finishing tools have developed over the years, such as rotary sanders, which are used in finishing the surface of a workpiece. Generally speaking, these tools rotate an abrasive material across the workpiece to scour or sand away the surface of the workpiece.

A rotary sander has a motor which drives a substantially planar disc, with abrasive elements bonded to it, in a circular motion across the work surface. The abrasive particles scrape off the top coating or surface of the work piece. A common type of disc used with these sanders comprises a fiber substrate onto which sharp, abrasive particles are securely bonded with a phenolic resin coating. The cured resin coating locks the sharp abrasive particles onto a fiber substrate. Rotary sanders are relatively inexpensive and easy to use and, accordingly, are very popular in surface finishing.

The design of a rotary abrasive disc requires balancing the operational life of the disc against the "aggressiveness" of the abrasive. Aggressiveness relates to how much surface material is removed. In order to provide a high degree of aggressiveness, it is desirable to have relatively large abrasive particles on a rigid substrate, such as in the resin fiber disc described above. However, an aggressive abrasive surface has drawbacks which limit its effectiveness. For example, referring to FIG. 1*a*, an enlarged view of a resin fiber disc 10 is shown which includes irregularly-shaped large and small abrasive particles 12 bonded to a fiber substrate 14. During use, the large abrasive particles, which are the first particles to contact the work surface, begin to wear and become dull, leading to the formation of flat spots 16 (FIG. 1*b*) on the disc 10. The flattened particles, too dull to continue to cut, "ride" on the work surface and prevent the smaller, still sharp, abrasive particles from contacting the work surface. This is commonly referred to as "glazing". Testing has shown that the flattening or glazing of as little as 10% of the disc surface may be sufficient to render the entire disc unusable. As a result, the disc must be replaced after a relatively short period of time. While the operator may increase the amount of pressure exerted on the disc, thereby forcing the smaller abrasive particles into contact with the work surface and increasing the amount of cutting provided by the disc, the increased exertion will result in increased operator fatigue.

Another drawback to the use of resin fiber discs is that the material removed from the workpiece tends to become lodged between the large abrasive particles, "loading" the abrasive and preventing the abrasive particles from effectively cutting the surface. Consequently, during a typical surface finishing operation, an operator will be required to replace the abrasive disc several times due to wear. While changing one disc may only take several minutes to accomplish, the cumulative downtime involved in changing several discs can be quite significant.

Additionally, any time a finishing process is stopped before completion, there is a chance that the surface finish itself will be adversely affected. More particularly, during a sanding process, an operator attempts to exert a standard amount of pressure on the work surface and maintain a continuous and consistent rate of motion across the surface.

When the operator stops to change a worn abrasive disc and then restarts the finishing process, the sharp abrasive particles on the new disc will cause a significantly greater amount of material to be removed, potentially resulting in a difference in the final surface finish.

A new development in the field of sanding devices is the rotary flap disc 18, illustrated in FIG. 2, which includes a series of rectangular abrasive flaps 20 mounted around the circumference of a backing plate 22. The flaps utilized in these discs have abrasive particles 24 adhesively bonded to a cotton or polyester cloth substrate 26 by means of a phenolic resin. The unique feature of flap discs 18 is that the rectangular abrasive flaps 20 overlap one another in a stacked or shingled arrangement, as shown. Accordingly, as the exposed edges of the abrasive flaps 20 begin to wear, the dull abrasive particles 24 begin to break away from the cloth substrate 26 and are removed from the workpiece with the chips. The exposed, relatively flexible, cloth fibers of the substrate 26 quickly wear and break away, exposing the new abrasive particles on the underlying flap. Hence, the operator can continue to sand for a longer period of time before having to stop and change discs. As a result, the down-time in the sanding process is significantly reduced.

While the stacked or flap-type discs provide increased life over flat discs, thus reducing the number of disc replacements required during a given sanding process, they nevertheless wear more rapidly than desired.

A need therefore exists for an improved finishing disc which provides optimal material removal with increased disc life.

SUMMARY OF THE INVENTION

An object of the invention is to provide a flap disc with abrasive flaps that have increased life and efficiency.

Another object of the invention is to provide a flap disc with rigid abrasive flaps that tear away during use.

These and other objects are provided by the flap disc of the present invention for use with a surface finishing tool which has a drive shaft that transmits rotary motion to the disc. The flap disc, according to the present invention, includes a backing plate which attaches to and is rotated by the drive shaft of the finishing tool. The backing plate, preferably, has a generally circular mounting flange which defines a first plane.

A plurality of abrasive flaps are radially disposed on the mounting flange, each abrasive flap having an outer surface and an inner surface. A portion of the inner surface is adhesively attached to the mounting flange with a second portion of the inner surface being disposed on the outer surface of an adjacent abrasive flap in an overlapping fashion so as to position the outer surface of the abrasive flaps at an angle to the first plane.

Each abrasive flap has a finishing layer which comprises abrasive particles bonded to a substrate with a resin binder. One surface of said finishing layer defines the outer surface of the abrasive flap. One side of the substrate attaches to the finishing layer and the other side defines the inner layer.

In one embodiment of the invention, the substrate is made from fiber material onto which the abrasive particle/resin mixture is adhesively attached.

Alternately, the substrate comprises a non-woven fibrous material onto which the abrasive particle/resin mixture is adhesively bonded such that the non-woven material extends into the finishing layer.

The mounting flange of the backing plate comprises, in one embodiment of the invention, a plurality of fiberglass plies intermixed in a resin matrix. Abrasive particles are, preferably, incorporated into the resin matrix to provide an additional mechanism for sanding a work piece.

The foregoing and other objects features and advantages of the present invention will become more apparent in light of the following detailed description of the preferred embodiments thereof, as illustrated in the accompanying drawings.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1A:
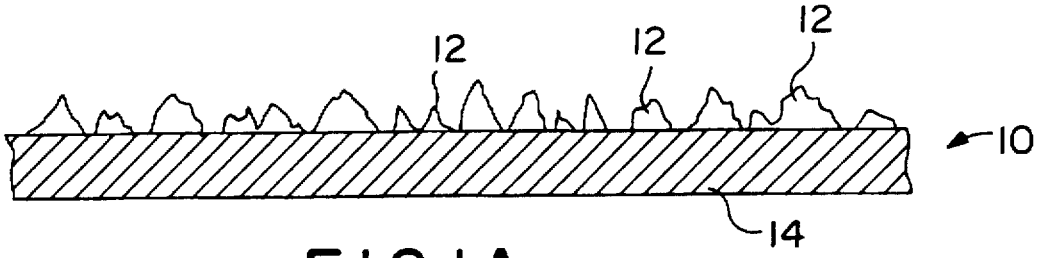
FIG. 1A PRIOR ART
Figure 1*a* is an enlarged cross-sectional view of the surface of a prior art resin fiber disc before use.
Figure 1B:
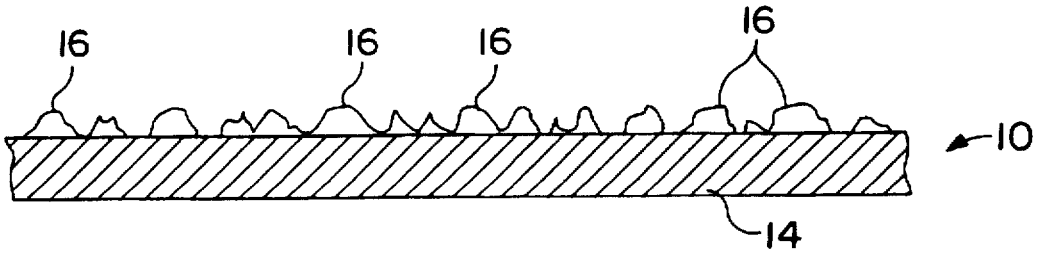
FIG. 1B PRIOR ART
Figure 1*b* is an enlarged cross-sectional view of the surface of a prior art resin fiber disc after use.
Figure 3:
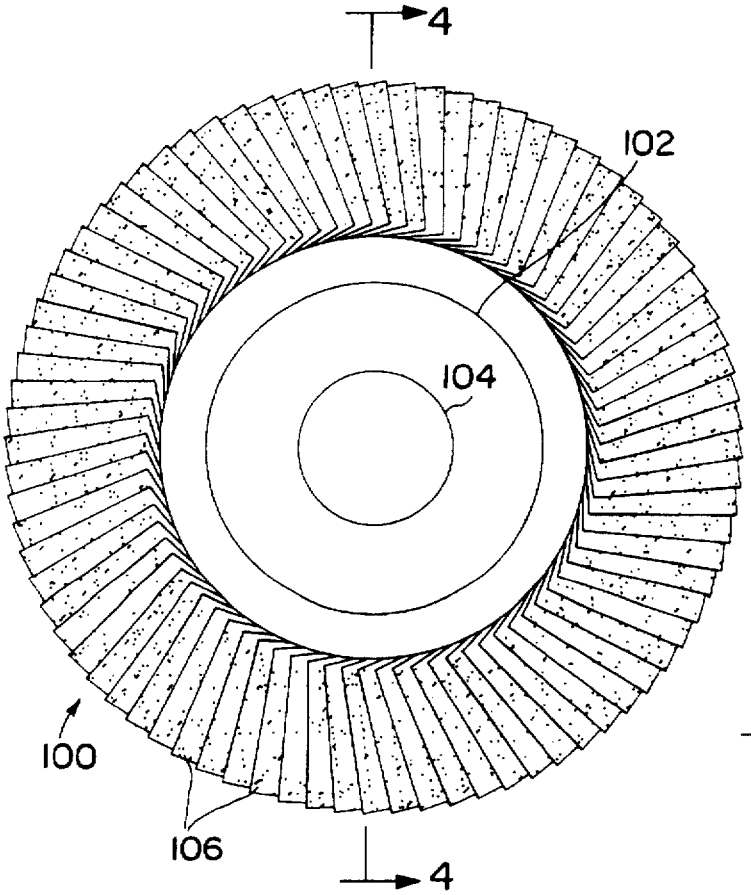
FIG. 3 is a plan view of a finishing disc according to the invention.

Referring now to the drawings, wherein like reference numerals illustrate corresponding or similar elements throughout the several views, FIG. 3 illustrates a plan view of a surface finishing disc 100 according to the present invention, for use with a rotary surface finishing tool (not shown). The finishing disc 100 has a backing plate 102 with an aperture 104 formed through it for attaching the disc 100 to the finishing tool. More specifically, the aperture 104 is sized to accept a drive shaft from the surface finishing tool which transmits rotary motion to the disc. The aperture 104 is, preferably, centrally located so as to produce substantially circular motion of the disc 100 when rotated. The disc 100 also includes a plurality of abrasive flaps 106 arranged in an overlapping fashion around the periphery of the disc 100. The abrasive flaps 106 are arranged such that, when the disc 100 is attached to a surface finishing tool and brought into contact with a work surface (not shown), the rotation of the disc 100 causes the abrasive flaps 106 to sand or abrasively wear away the work surface.

Figure 4:
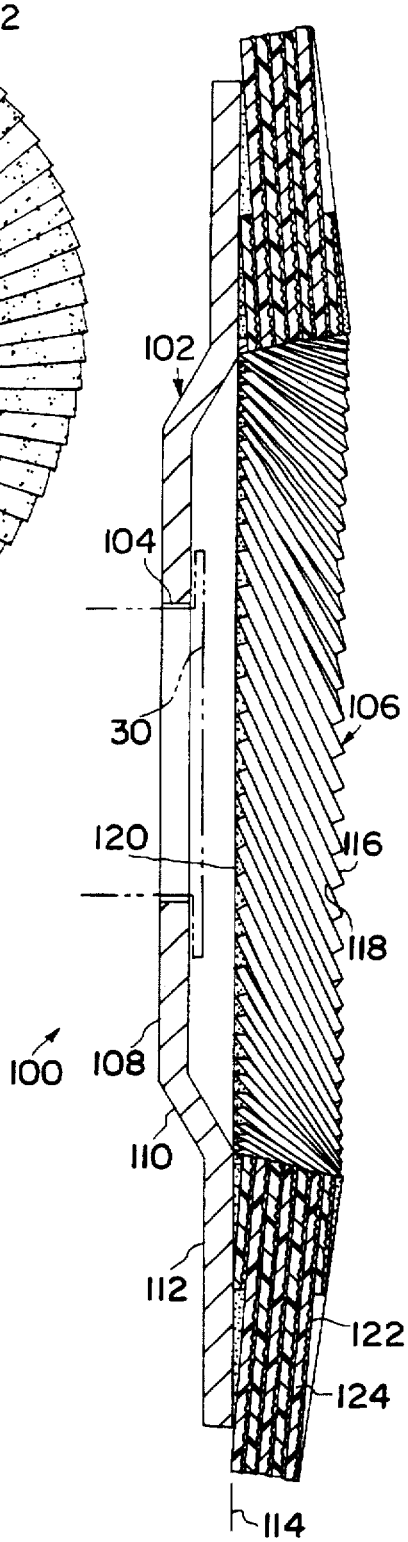
FIG. 4 is a cross-sectional view of the finishing disc taken along lines 4—4 in FIG. 1.

Referring now to FIG. 4, the backing plate 102 has a first planar surface 108 which extends outward from the aperture 104 to a stepped portion 110. The stepped portion 110 extends away from the backing plate 102 towards an annular mounting flange 112 which defines a plane 114. The stepped portion 110 is configured so as to locate the mounting flange 112 apart from the end of the drive shaft (shown in phantom and designated by numeral 30) of the finishing tool which protrudes through the aperture 104 so as to leave room for a fastener to fasten the disc 100 to the drive shaft. The size and shape of the aperture 104, first planar surface 108, stepped portion 110 and mounting flange 112 will vary depending on, but not limited to, the speed at which the disc 100 is to be rotated, the number and size of the abrasive flaps 106 placed on the disc 100, the type of surface preparation tool desired, and the mounting arrangement chosen for attaching the disc 100 to the drive shaft. For example, if the attachment of the disc 100 to the drive shaft is such that the end of the drive shaft 30 does not protrude through the aperture 104, a stepped portion 110 may not be required. Accordingly, the first planar surface 108 and the mounting flange 112 may lie along substantially the same plane 114. Those skilled in the art will understand and appreciate the diverse backing plate 102 configurations which may be practiced within the scope of this invention.

The mounting flange 112, planar surface 108 and stepped portion 110 may be fabricated as independent components which are subsequently attached to one another to form the backing plate 102. Alternately, and more preferably, the mounting flange 112, stepped portion 110 and planar surface 108 are formed integral with one another.

As shown in FIGS. 3 and 4, each abrasive flap 106 has an outer surface 116 and an inner surface 118. The abrasive flaps 106 are depicted as rectangular in shape, although other shapes may be used without departing from the invention. The outer surfaces 116 define the finishing surface of the disc 100.

A portion of the inner surface 118 of each abrasive flap 106 is attached to the mounting flange 112 by means of an adhesive 120. The adhesive 120 is preferably chosen to work well under the high pressure and temperature conditions present during a normal finishing operation. However, the adhesive 120 should also be capable of breaking down if it comes into contact with the work surface as will be explained in more detail below. In the preferred embodiment, the adhesive 120 is an epoxy type of adhesive. Naftotec™ manufactured by Chemetall is an example of such an adhesive.

The bonding of a portion of the inner surface 118 to the mounting flange 112, in combination with the overlapping arrangement of the abrasive flaps 106 upon one another, results in the outer surface 116 being positioned at an angle with respect to the plane 114 defined by the mounting flange 112. The angular position of the outer surface 116 of the abrasive flaps 106 defines the point of contact between the finishing disc 100 and the work surface. It is this portion of the abrasive flaps 106 which will begin to wear first.

Figure 2:
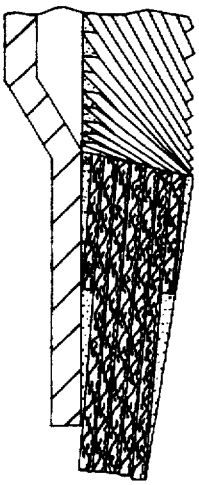
FIG. 2 PRIOR ART
FIG. 2 is a detail view of a prior art flap disc.

As discussed above, FIG. 2 illustrates a prior art flap disc 18 with flaps 20 consisting of abrasive particles 24 adhesively bonded to a cloth substrate 26. Cloth flaps 20 used in the prior art disc were, until the present invention, thought to be the only type that would function properly. That is, it was thought that only flaps made from abrasive particles bonded to a cloth substrate would be flexible and fragile enough to tear completely away to expose the underlying layer. An abrasive flap consisting of abrasive particles adhesively bonded to a fiber substrate was thought to be too rigid to wear completely away, i.e., it was believed that the substrate would not break away with the abrasive particles to expose new abrasive particles to the work surface. Instead, it was felt that glazing would occur, in which the larger particles would simply become dull and ride on the work surface, preventing the small sharp abrasive particles from cutting. Similarly, surface conditioning abrasive flaps, made from non-woven materials with a surface coating of abrasive particles in a resin binder, were also thought to be too tough to use in flap discs since it was thought that they would not wear through to expose an underlying layer. Consequently, those skilled in the art did not look to non-woven materials or to the use of fiberglass or resin substrates when constructing the flap-type discs.

However, the inventor has determined that, contrary to expectations, the utilization of abrasive flaps 106 consisting of abrasive particles adhesively bonded to a rigid fiber substrate will, indeed, tear away sufficiently to expose an underlying layer of abrasive particles. The angular positioning of the abrasive flaps 106 with respect to the work surface, produced by the overlapping or shingled stacking of the flaps, results in the large abrasive particles and the rigid substrate being slowly torn away as they wear.

Figure 5A:
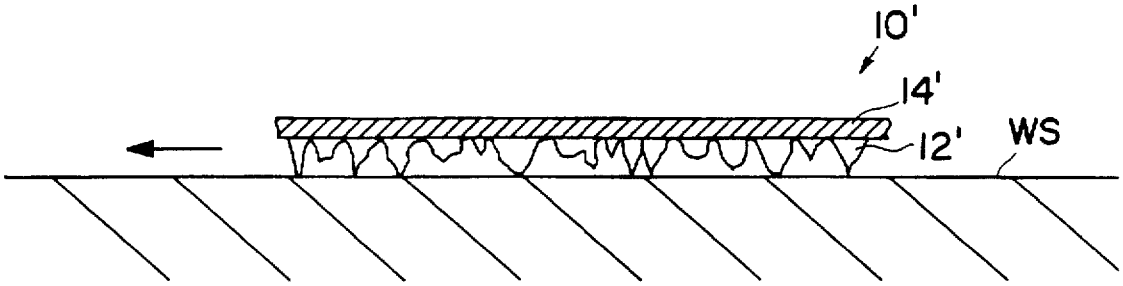
FIG. 5A PRIOR ART
FIG. 5*a* is an enlarged view showing contact between a planar abrasive disc and a work surface.

FIG. 5*a* shows a portion of a typical planar resin fiber disc designated 10' with abrasive particles 12' bonded to a fiber substrate 14'. The motion of the planar disc 10' is in the direction of the arrow shown. The frictional contact between the planar disc 10' and the work surface WS results in loads applied to the disc 10' along a plane parallel to the substrate 14'. These loads are greatest when the disc 10' is relatively new, i.e., the abrasive particles 12' are sharp. As the abrasive particles 12' begin to wear and become rounded, the frictional forces decrease resulting is reduced loads applied to the substrate 14'. Accordingly, unless additional force is applied against the work surface, the abrasive particles 12' in a planar disc 10' are less likely to be torn off as they wear.

Figure 5B:
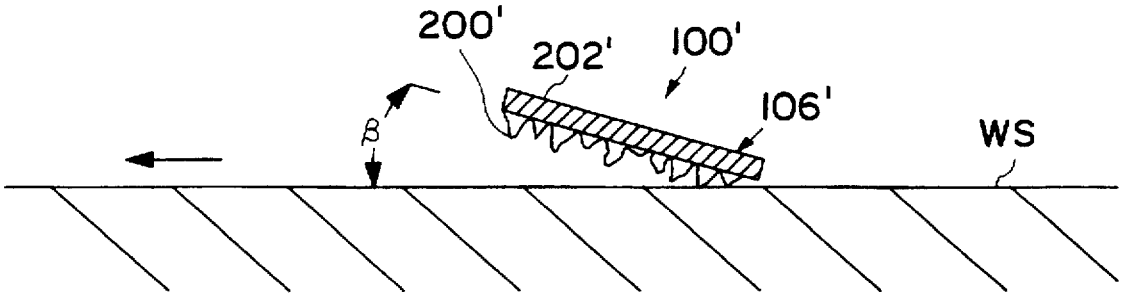
FIG. 5*b* is an enlarged view showing contact between an abrasive flap according to the present invention and a work surface.

Referring now to FIG. 5*b*, a single abrasive flap 106' of a flap disc 100' is shown. While one abrasive flap 106' is shown, it should be understood that a flap disc 100' typically includes a plurality of abrasive flaps 106'. However, for the sake of clarity, only one abrasive flap 106' is shown. The abrasive flap 106' comprises abrasive particles 200' bonded to a fiber substrate 202' by means of a resin binder. The abrasive flap 106' is positioned at an angle β with respect to work surface WS and rotates in the direction indicated by the arrow. The frictional contact between the disc 100' and the work surface WS, as well as the angular position of the abrasive flap 106', results in loads being applied to the substrate 202' that have force components both parallel and perpendicular to the substrate 202'. As a consequence, after the abrasive particles 200' have worn so as to be rounded, there is still a component of the frictional force acting perpendicular to the substrate. This perpendicular component eventually leads to the worn abrasive particles 200' and the associated substrate 202' tearing away from the remainder of the abrasive flap 106'. As a result, the adjacent sharp abrasive particles 200' will begin to contact the work surface WS until they, too, are torn away. After a significant portion of the abrasive flap has torn away, the underlying abrasive flap (not shown in this figure) having still sharp particles, will begin to contact the work surface WS for further surface finishing.

Referring back to FIG. 4, one embodiment of the invention is shown wherein the abrasive flaps 106 have an abrasive finishing layer 122 which includes abrasive particles such as aluminum oxide. The finishing layer 122 is attached to a substrate 124, preferably by means of a resin binder such as Naftotec™ manufactured by Chemetall. In a preferred embodiment of the invention, the substrate 124 comprises a fiber material coated with a resin binder to form a resin fiber layer. The resin is, preferably, a phenolic resin such as Cascophen™ manufactured by Borden, and the fiber material is, preferably, a vulcanized cotton material. Other materials, such as fiberglass, may be utilized in the substrate so long as the chosen material is capable of breaking away after the abrasive particles have worn. The fiber substrate in this embodiment retains the abrasive particles until they are sufficiently worn, at which point the loads applied to the abrasive flaps 106 cause the particles to tear away and expose new abrasive material.

Referring to Table 1, an abrasive flap 106 made in accordance with the preferred embodiment, i.e., a finishing layer 122, comprising abrasive particles, bonded to a fiber substrate 124, was tested against a standard flap disc made with a abrasive particles bonded to a cloth substrate. The testing parameters included the application of a 15 pound force onto cold rolled steel with a disc rotating at 8500 RPM for a 30 minute period. The abrasive particles utilized with both flap discs was zirconium oxide.

The results of the tests are shown including the work performance ratio, which is indicative of the flap disc efficiency. The work performance ratio compares the amount of flap disc material loss with the amount of surface material removed from the wear plate. The results of the test show that a flap disc including resin fiber abrasive flaps made in accordance with the present invention had 53% less loss of flap disc material as compared with the standard flap discs. Hence, the flap disc of the present invention retains the abrasive particles longer than the prior art flap discs and, therefore, has increased overall disc life. Furthermore, since the present invention flap disc removed substantially the same amount of material as the prior art flap disc with less wear, the overall efficiency is greater.

Figure 6:
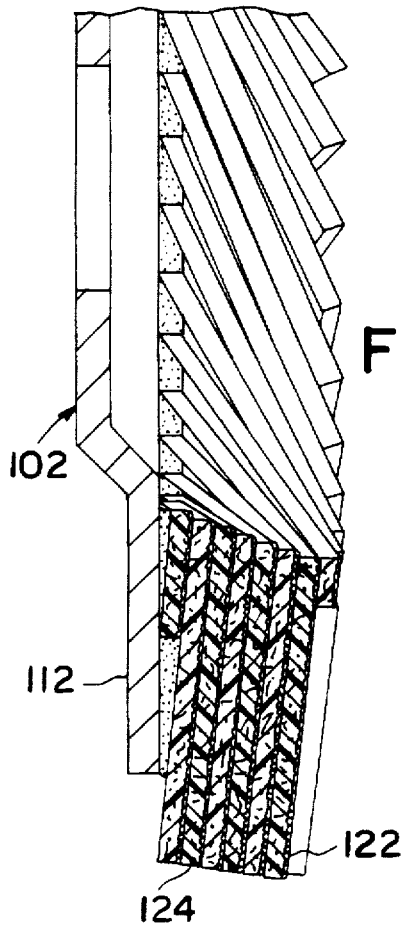
FIG. 6 is a detail view of an alternate embodiment of a finishing disc according to the present invention.

In alternate embodiment of the invention, shown in FIG. 6, the substrate 124 comprises a non-woven abrasive fabric, such as crimped staple fibers sold under the registered trademark "Scotch-Brite" by the 3M Company of St. Paul, Minn. and disclosed in U.S. Pat. No. 2,958,593. The finishing layer 122 is formed by bonding an abrasive particle and resin combination to the surface of the non-woven fiber substrate 124. The finishing layer 122 may be manufactured separately then subsequently bonded to the top of the substrate 124. Alternately, and more preferably, the abrasive particle and resin combination of the finishing layer 122 is coated onto the upper portion of the non-woven fibers of the substrate 124 so that the resin bonds to the fibers of the substrate thereby forming an integral combination. The non-woven fabric may comprise randomly oriented nylon fibers bonded with a phenolic resin. Accordingly, the non-woven fibers are continuous between the substrate 124 and the finishing layer 122. This type of material is commonly referred to as "surface conditioning".

Prior to testing, it was thought that a flap disc made from non-woven fibers would not be efficient since it was believed that the fibers would quickly become loaded with the removed material and ride on the surface of the work piece. A flap disc 100 was constructed in accordance with this alternate embodiment and tested. The results are set forth in Table 2 and are compared with testing performed on a standard planar disc made with non-woven surface conditioning fabric in a similar fashion to the flap disc 100. The test parameters included the application of 8 pounds of force onto a ½ inch wide piece of cold rolled steel with the disc rotating at 8500 RPM. After 10 minutes of operation, the outer edges of the planar, non-woven disc started to wear away. After 22.5 minutes of operation, the outer edges of the flap disc, made in accordance with the present invention, were worn out although additional material remained on the inner edges. As is evident from the results shown in the table, the work performance ratio, which is indicative of the efficiency of the flap disc, was greater for the present invention flap disc 100. Hence, contrary to expectations, a flap disc 100 made in accordance with the present invention has an increased life compared with a standard planar disc and, therefore, results in less overall "down-time" during a typical finishing operation.

In an alternate configuration of the non-woven fiber substrate embodiment discussed above, abrasive particles and resin may be located throughout the non-woven fabric of the substrate 124. Hence, the finishing layer 122, effectively, forms a substantial portion, if not the entire, substrate 124. As the uppermost abrasive particles are torn off of the substrate, new abrasive particles will continuously be exposed to the work surface. The resin also assists in stabilizing the substrate 124 so as to provide a relatively rigid foundation for holding the abrasive particles.

Figure 8:
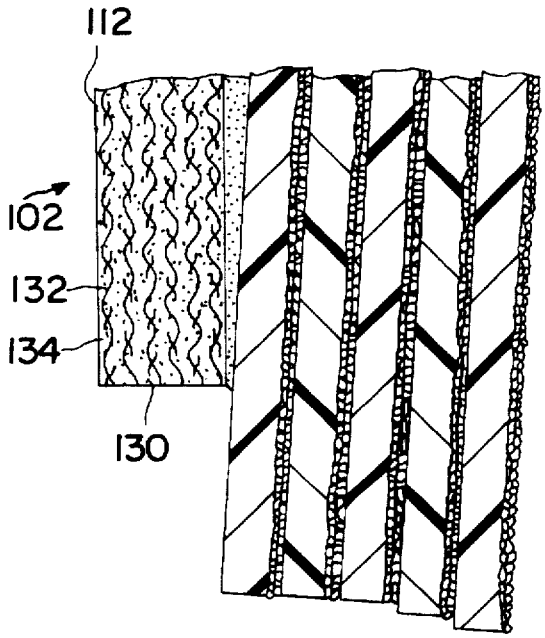
FIG. 8 is an enlarged view of the embodiment of the finishing disc shown in FIG. 7.
Figure 7:
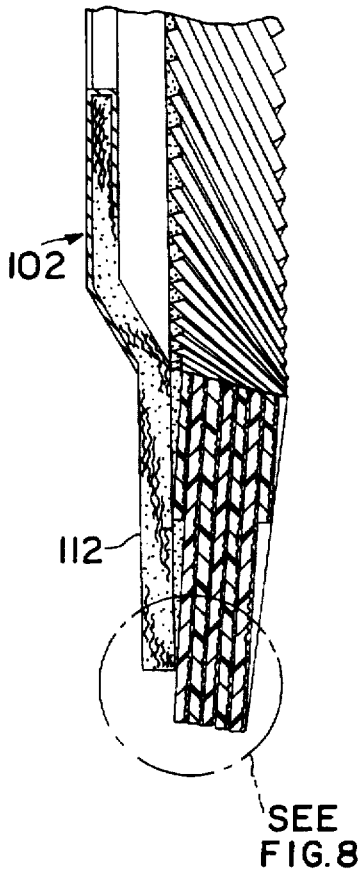
FIG. 7 is a detail view of a finishing disc according to the present invention with an alternate backing plate embodiment.

During the normal finishing operations, the mounting flange 112 of the backing plate 102 may come into contact with the work surface. That is, all the abrasive flaps 106 may, eventually, tear off exposing the work surface to the mounting flange 112. As a consequence, the mounting flange 112, which is typically made from a rigid material, such as aluminum, steel, or fiberglass, may contact the work surface and cause damage to the workpiece. Referring now to FIGS. 7 and 8, to prevent this problem from occurring, the mounting flange 112 in the present invention may be made from a fiber-reinforced resin matrix material which has abrasive particles 130 bonded onto its surface or, more preferably, imbedded therein, in a fashion similar to grinding wheels. Accordingly, when the abrasive flaps 106 on the disc 100 wear away, the abrasive particles 130 in the mounting flange 112 continue to sand the workpiece until the operator changes the flap disc 100.

In a specific embodiment of the invention, the mounting flange 112 is made from a plurality of fiberglass plies 132 in a resin matrix 134 imbedded with fine grains of abrasive material 130. Preferably, there are two or more fiberglass plies, each ply having a thickness of about 1/32nd of an inch, in a phenolic resin, such as Cascophen™ manufactured by Borden. The abrasive particles are $Al_2O_3$ manufactured by Washington Mills. It is important to note that the construction of the flap disc 100 of the present invention with the plurality of rigid abrasive flaps 106, results in increased centrifugal loads being applied on the mounting flange 112 and backing plate 102. Accordingly, a larger number of fiberglass plies may be required in the backing plate 102 of the present invention as compared with existing backing plates, to provide the required strength and rigidity.

It is contemplated that the abrasive particles may differ between the abrasive flap 106 and the mounting flange 112. That is, the abrasive particles 130 utilized in the mounting flange 112 may be finer in grit than the abrasive particles utilized in the abrasive flaps 106, such that the mounting flange 112 will produce smaller scratches in the surface of the workpiece after the abrasive flaps 106 have removed the upper coating or surface of the workpiece.

It may also be desirable to incorporate an indicator means on the mounting flange 112 or between the abrasive flaps 106 and the mounting flange 112, so that when the abrasive flaps 106 wear away, the operator is immediately notified that the mounting flange 112 is or will be coming into contact with the work surface. A suitable indicating means may consist of a coloring or dye added to the adhesive 120, the resin 134, or placed on the abrasive particles 130, which will appear on the work surface when the particles or resin begin to wear.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

TABLE 1

| DISC TYPE | DISC MATERIAL LOSS IN GRAMS (A) | WEAR PLATE MATERIAL REMOVED IN GRAMS (B) | WORK PERFORMANCE RATIO (C = B/A) |
|---|---|---|---|
| Standard Flap Disc (Flaps = 36 grit abrasive particles bonded to cloth carrier) | 15.33 | 1339.2 | 87.4 |
| Weiler Special 1 (Flaps = 36 grit abrasive particles bonded to fiber flap, flap length = 7/8ths of an inch) | 7.1 | 1289.8 | 181.7 |
| Weiler Special 2 (Flaps = 36 grit abrasive particles bonded to fiber flap, flap length = 5/8ths of an inch) | 7.2 | 1328.8 | 184.6 |

TABLE 2

| DISC TYPE | DISC MATERIAL LOSS IN GRAMS (A) | WEAR PLATE MATERIAL REMOVED IN GRAMS (B) | WORK PERFORMANCE RATIO (C = B/A) |
|---|---|---|---|
| Standard Planar Disc (Medium Grade, Non-woven Surface Conditioned) | 7.8 | 18.4 | 2.36 |
| Weiler Flap Disc (Medium Grade, Non-woven, Surface Conditioned) | 16.8 | 56.2 | 3.34 |

What is claimed:

1. A flap disc for use with a surface finishing tool, the tool having a drive shaft for transmitting rotary motion to the disc, wherein the disc comprises:

a backing plate for attaching to and being rotated by the drive shaft and having a generally circular mounting flange which defines a first plane, wherein said backing plate includes a plurality of resin impregnated fiberglass plies, and abrasive materials; and a plurality of abrasive flaps radially disposed on the mounting flange and each having an outer surface and an inner surface, a portion of said inner surface being adhesively attached to said mounting flange and a second portion of said inner surface being disposed on said outer surface of an adjacent abrasive flap in an overlapping fashion so as to position said outer surface of said abrasive flap at an angle to said first plane, wherein said abrasive flaps comprise:

a finishing layer including a plurality of abrasive particles in a resin binder, one surface of said finishing layer defining said outer surface; and a substrate having first and second sides, one side of said substrate attaching to said finishing layer and the second side defining said inner layer, said substrate including a resin binder.

2. A flap disc for use with a surface finishing tool, the tool having a drive shaft for transmitting rotary motion to the disc, wherein the disc comprises:

backing plate for attaching to and being rotated by the drive shaft and having a generally circular mounting flange which defines a first plane, wherein said backing plate includes a plurality of resin impregnated fiberglass plies, and abrasive materials imbedded in said resin impregnated fiberglass plies; and a plurality of abrasive flaps radially disposed on the mounting flange and each having an outer surface and an inner surface, a portion of said inner surface being adhesively attached to said mounting flange and a second portion of said inner surface being disposed on said outer surface of an adjacent abrasive flap in an overlapping fashion so as to position said outer surface of said abrasive flap at an angle to said first plane, wherein said abrasive flaps comprise:

a finishing layer including a plurality of abrasive particles in a resin binder, one surface of said finishing layer defining said outer surface; and a substrate having first and second sides, one side of said substrate attaching to said finishing layer and the second side defining said inner layer, said substrate including a resin binder.

3. A flap disc for use with a surface finishing tool, the tool having a drive shaft for transmitting rotary motion to the disc, wherein the disc comprises:

a backing plate for attaching to and being rotated by the drive shaft and having a generally circular mounting flange which defines a first plane; and a plurality of abrasive flaps radially disposed on the mounting flange and each having an outer surface and an inner surface, a portion of said inner surface being adhesively attached to said mounting flange and a second portion of said inner surface being disposed on said outer surface of an adjacent abrasive flap in an overlapping fashion so as to position said outer surface of said abrasive flap at an angle to said first plane, wherein said abrasive flaps comprise:

a finishing layer defining said outer surface and including a plurality of abrasive particles in a resin material; and a substrate having first and second sides, one side of said supporting layer attaching to said finishing layer, and the second side defining said inner layer, said substrate comprising non-woven material.

4. A flap disc according to claim 3 wherein said resin of said finishing layer is adhesively bonded to said non-woven material of said substrate.

5. A flap disc for use with a surface finishing tool, the tool having a drive shaft for transmitting rotary motion to the disc, wherein the disc comprises:

a backing plate for attaching to and being rotated by the drive shaft and having a mounting flange, said mounting flange defining a first plane and including abrasive material; and a plurality of abrasive flaps radially disposed on the mounting flange and each having an outer surface and an inner surface, a portion of said inner surface being adhesively attached to said mounting flange and a second portion of said inner surface being disposed on said outer surface of an adjacent abrasive flap in an overlapping fashion so as to position said outer surface of said abrasive flap at an angle to said first plane, wherein said abrasive flaps comprise:

a finishing layer of abrasive materials defining said outer surface;

a substrate having first and second sides, one side of said supporting layer attaching to said finishing layer, and the second side defining said inner layer.

6. A flap disc according to claim 5 wherein said abrasive material in said backing plate is located on the surface of said mounting flange.

7. A flap disc according to claim 5 wherein said abrasive material in said backing plate is located throughout said mounting flange.

8. A flap disc for use with a surface finishing tool, the tool having a drive shaft for transmitting rotary motion to the disc, wherein the disc comprises:

a backing plate for attaching to and being rotated by the drive shaft and having a generally circular mounting flange which defines a first plane; and a plurality of abrasive flaps radially disposed on the mounting flange and each having an outer surface and an inner surface, a portion of said inner surface being adhesively attached to said mounting flange and a second portion of said inner surface being disposed on said outer surface of an adjacent abrasive flap in an overlapping fashion so as to position said outer surface of said abrasive flap at an angle to said first plane, wherein said abrasive flaps comprise:

a finishing layer including a plurality of abrasive particles in a resin binder, one surface of said finishing layer defining said outer surface; and a substrate having first and second sides, one side of said substrate attaching to said finishing layer and the second side defining said inner layer, said substrate including a resin binder, said substrate further including a fiber backing, said resin binder in said substrate being coated onto said fiber backing, and wherein said fiber backing comprises a non-woven vulcanized cotton.

* * * * *